United States Patent [19]

Menser et al.

[11] Patent Number: 4,915,989

[45] Date of Patent: Apr. 10, 1990

[54] PRESSURE SATURATOR AND METHOD

[75] Inventors: Howard K. Menser, Plymouth, Ind.; Eliot R. Long, Arlington Heights, Ill.

[73] Assignee: Miply Equipment, Inc., Plymouth, Ind.

[21] Appl. No.: 243,583

[22] Filed: Sep. 12, 1988

Related U.S. Application Data

[63] Continuation-in-part of Ser. No. 230,742, Aug. 9, 1988, abandoned.

[51] Int. Cl.[4] ..... B05D 1/18

[52] U.S. Cl. ..... 427/434.2; 427/430.1; 118/70; 118/419; 118/423; 118/428

[58] Field of Search ..... 427/434.2, 430.1; 118/70, 419, 423, 428

[56] References Cited

U.S. PATENT DOCUMENTS

| | | | |
|---|---|---|---|
| 242,839 | 6/1881 | Page | 422/8 |
| 1,276,439 | 8/1918 | Sutherland | 118/433 |
| 2,104,052 | 1/1938 | Novak | 92/40 |
| 2,877,739 | 3/1959 | Payne | 118/419 |
| 2,993,470 | 7/1961 | Stickel | 118/407 |
| 3,032,816 | 5/1962 | Zimmerli | 18/15 |
| 4,411,216 | 10/1983 | Menser | 118/117 |
| 4,588,616 | 5/1986 | Menser | 427/430.1 |
| 4,598,662 | 7/1986 | Chen | 118/34 |
| 4,702,943 | 10/1987 | Long | 427/282 |

OTHER PUBLICATIONS

Beloit Tri-Nip Press, Paper Machine Division, Beloit Corporation, Beloit, Wis. "efficient water removal with minimum downtime for felt changing".

Beloit Extended Nip Press for Board Grades, Paper Machine Division, Beloit, Wis. "increased water removal for superior productivity and profitablility".

*Primary Examiner*—Shrive Beck
*Assistant Examiner*—Alain Bashore
*Attorney, Agent, or Firm*—Willian Brinks Olds Hofer Gilson & Lione

[57] ABSTRACT

A pressure saturator system includes a grooved mandrel and an opposed element which define a converging chamber therebetween. A web is passed through the chamber with a first side of the web adjacent the mandrel. A liquid saturant is introduced into the chamber such that the saturant contacts the second side of the web and impregnates the web as the web passes through the chamber. A gas receiving belt is passed through the chamber with the belt interposed between the web and the mandrel and in contact with the first side of the web. The belt receives gases and any excess saturant form the first side of the web as the saturant enters the web in the chamber, thereby facilitating the removal of gases from the web, improving the saturation process, and protecting the mandrel from undesired contact with the saturant. In alternate embodiments the betls is formed of a porous material or defines an array of gas receiving slots positioned against the first side of the web.

38 Claims, 2 Drawing Sheets

PRESSURE SATURATOR AND METHOD

CROSS REFERENCE TO RELATED APPLICATION

This is a continuation-in-part of copending U.S. patent application Ser. No. 07/230,742, filed Aug. 9, 1988 now abandoned.

BACKGROUND OF THE INVENTION

This invention relates to an improved pressure saturator system which removes gases and excess saturant from a substrate or web during the pressure saturation process.

Pressure saturators are devices which impregnate a porous substrate such as paper with a liquid saturant. A wide variety of saturants are used, depending upon the physical or chemical properties desired for the impregnated substrate.

One common problem encountered in impregnating a porous substrate such as paper relates to the removal of air within the substrate. Such air tends to block the saturant from entering the substrate. If air is not allowed to leave the substrate properly, high pressure systems such as pressure rollers can trap the air within the substrate, and compress it. When pressure is released, any compressed air will re-expand and may tend to push the saturant back to the surface of the substrate. Certain dip tank saturators allow the air to dissolve into the saturant liquid. This approach can take a relatively long time to accomplish, which slows the saturating system.

Vacuum saturators have been proposed in which gases are first removed from the substrate before the substrate is immersed in the saturant. This approach has been used successfully; however suitable vacuum systems are relatively expensive to construct and operate. Furthermore, in practice a complete vacuum is typically unattainable, and some air remains within the substrate.

Menser U.S. Pat. No. 4,588,616 discloses an improved saturator system which employs a converging chamber defined by a mandrel and an opposed chamber defining element. The substrate to be saturated enters the chamber tightly wrapped around the mandrel. The saturant, located within the chamber, is impregnated into one surface of the substrate by hydrodynamic pressures created within the saturant by movement of the saturant and the substrate through the converging chamber. In the Menser saturator the mandrel is grooved to provide an escape path for gases from the substrate. As the saturant enters the substrate on one side, gases such as air exhaust out of the substrate through the opposite surface of the substrate. The grooves machined into the mandrel receive the air that leaves the substrate during saturation, and conduct this air circumferentially around the mandrel out of the chamber.

While the grooved mandrel of the Menser saturator has been shown to be very effective in use, limitations have been noted as well. The depth of the grooves in the mandrel influences the freedom with which gas is exhausted from the substrate, and therefore the volume of gases exhausted during the saturation process. Larger grooves allow a greater volume of gases to exhaust during saturation than do smaller grooves. Larger grooves however can cause distortion of the substrate, particularly when light weight substrates are processed. Such distortion can stretch and physically damage the substrate. For this reason, it may be appropriate in the Menser saturator to vary the width and depth of the grooves according to the weight of the substrate being processed and the depth of saturant penetration desired. However, since the grooves are machined into the mandrel surface, changing the depth of the grooves may necessitate changing mandrels, which is time consuming and expensive.

Another limitation of the Menser saturator is observed when operating parameters are chosen to impregnate the saturant completely through the substrate. Under these circumstances saturant emerges on the side of the substrate adjacent the mandrel, and this excess saturant can accumulate in the grooves of the mandrel. Such an accumulation of saturant reduces the depth of the grooves and therefore the flow of gases out of the substrate. Furthermore, such excess saturant can present a significant cleaning problem. With some saturants such as sodium silicate, any saturant that is allowed to dry on the mandrel is difficult to remove from the grooves.

It is an object of this invention to provide an improved saturator and saturating method which allow gas such as air in the substrate to be replaced with saturant right down to the fiber surfaces of the substrate. This is believed to provide optimal saturation, for the saturant is brought into intimate contact with the fibers of the substrate. For example, when the purpose of saturation is to create additional strength, it is desired that the saturant be impregnated into the substrate to reinforce the fiber junctions and the fiber walls.

It is a further object of this invention to provide a system that removes gases and any excess saturant from the side of the substrate adjacent the mandrel while minimizing or eliminating distortion of the substrate, and without requiring different mandrels for different weight substrates.

It is yet another object of this invention to provide a system which protects the mandrel from contact with excess saturant, thereby reducing mandrel cleaning requirements and allowing continuous, uninterrupted operation without accumulation of excess saturant on the mandrel.

SUMMARY OF THE INVENTION

According to this invention a pressure saturator is provided which comprises first and second elements configured to define a saturating zone therebetween. Means are provided for passing a substrate through the saturating zone with a first side of the substrate adjacent the first element. A liquid saturant is introduced into the saturating zone such that the saturant contacts the second side of the substrate and impregnates the substrate as it passes through the saturating zone. A belt is passed through the saturating zone with the belt interposed between the substrate and the first element and in contact with the first side of the substrate. This belt comprises means for receiving gases and at least some of any excess saturant from the first side of the substrate as the saturant enters the substrate in the saturating zone, thereby protecting the first element from contact with the saturant.

In one embodiment, the first element comprises a grooved rotatable mandrel, the belt is porous, and the saturating zone comprises a chamber that converges as described above such that movement of the substrate and the saturant through the chamber pressurizes the saturant in the exit region as compared with the entrance region. In many embodiments, it will be desirable to include a cleaning and drying system for the porous belt to remove excess saturant and to dry the belt after it leaves the exit region and before it re-enters the chamber.

In another embodiment, the gas receiving means in the belt comprises an array of slots in the belt extending along the direction of motion of the belt and positioned adjacent the substrate. Such a slotted belt can be changed to alter the slot configuration as necessary to provide appropriate support for the web and appropriate gas flow rates for the saturation level of any particular application. This eliminates the need to change the mandrel itself. If appropriate, the slotted belt can be passed through a cleaning system to remove excess saturant from the belt before it is recycled.

According to the method of this invention, gases and excess saturant are removed from the substrate during a saturation process. A liquid saturant is introduced into a saturating zone defined between two elements. A substrate is passed through the zone with the substrate positioned adjacent the first one of the elements while pressurizing the saturant in the zone to impregnate the saturant into the substrate. A belt having gas removal means is passed through the zone between the substrate and the first element to cause gases and at least some of any excess saturant from the substrate to enter the belt.

As with the apparatus of this invention, the zone is preferably a self pressurizing converging chamber, and in many applications it will be desirable to include cleaning and drying means for the belt. In alternate embodiments the gas removing belt can be formed of a porous material or can define an array of gas removal slots.

The gas removing belt of this invention substantially solves the problems of the prior art discussed above. With reference to the preferred embodiments described below, the belt is interposed between the mandrel and the substrate or web being impregnated. The belt bridges any grooves on the mandrel, and for this reason can be configured to substantially reduce or eliminate deformation of the substrate caused by the grooves in the mandrel. In this way, the saturating process is made to operate properly even on extremely light weight webs, without any alteration in the grooves of the mandrel or replacement of the mandrel itself. Furthermore, the belt receives excess saturant from the substrate during the saturating process, and allows consistent removal of gases from the substrate and the chamber. In particular, the mandrel is protected from contact with excess saturant, and any grooves in the mandrel remain open. For this reason, any flow of gases out of the chamber via the grooves in the mandrel is not obstructed by saturant. Furthermore, because the mandrel is protected from contact with excess saturant, cleaning problems of the mandrel are reduced or substantially eliminated, and long term continuous operation is facilitated. The belt can be cleaned before it is recycled through the chamber to ensure that the gas receiving means of the belt is in condition to receive gases from the substrate.

The invention itself, together with further objects and attendant advantages, will best be understood by reference to the following detailed description, taken in conjunction with the accompanying drawing.

DETAILED DESCRIPTION OF THE PRESENTLY PREFERRED EMBODIMENTS

Figure 1:
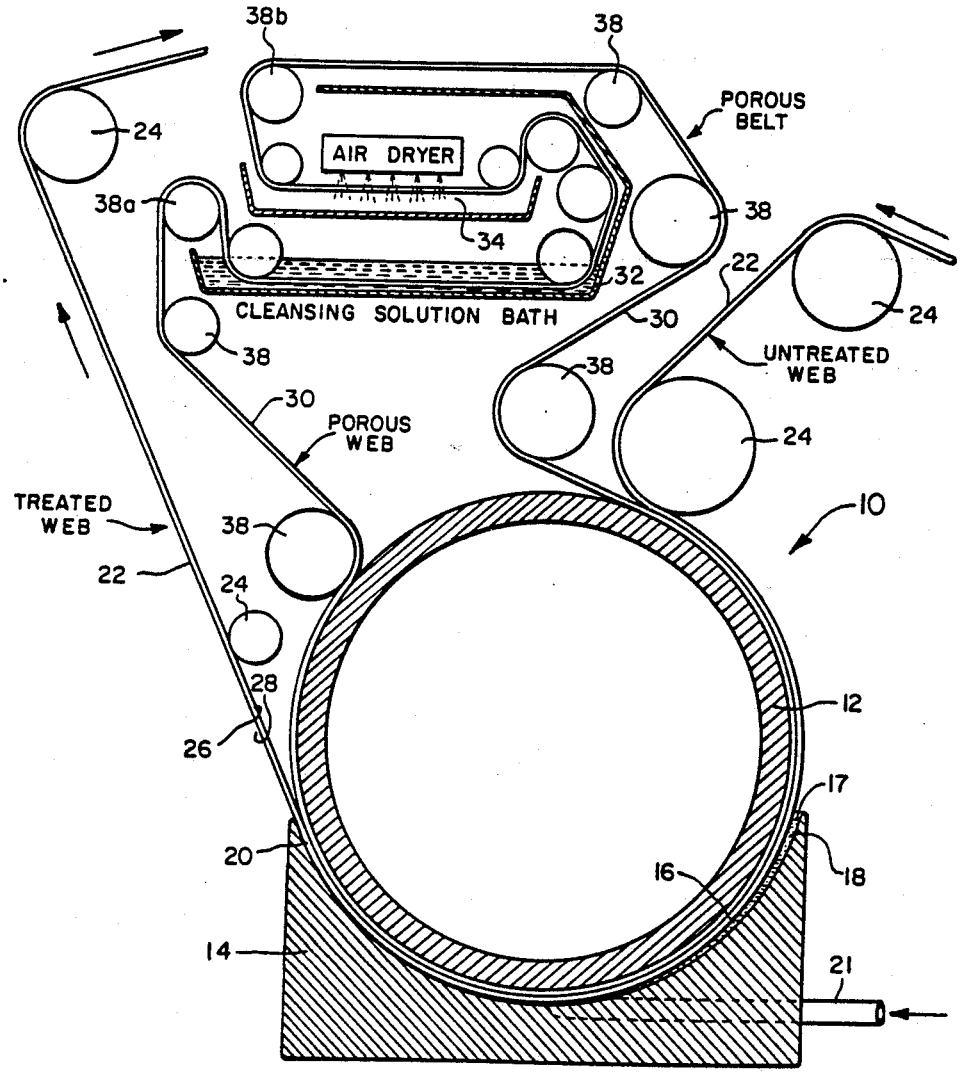
FIG. 1 is a schematic view of a pressure saturator which incorporates a presently preferred embodiment of this invention.

Turning now to the drawings, a first preferred embodiment 10 of the saturator of this invention includes a rotatable cylindrical mandrel 12 and an opposed element 14. The mandrel 12 and the opposed element 14 define a chamber 16 therebetween, which is filled with a liquid saturant 17. The chamber 16 defines an entrance region 18 and an exit region 20, and the entrance region 18 is substantially deeper than the exit region 20. A port 21 is provided in the element 14 to introduce the liquid saturant 17 into the chamber 16. Preferably, both the mandrel 12 and the element 14 are substantially rigid elements which do not flex or bend in use, and the element 14 remains fixed in place during use.

A porous web 22 such as a sheet of paper is passed through the chamber 16 by a system that includes guide rolls 24. This web 22 defines a first side 26 facing towards the mandrel 12, and a second side 28 that comes into contact with the liquid saturant 17 in the chamber 16.

The features of the saturator 10 described above are conventional, and are described in greater detail in Menser U.S. Pat. No. 4.588,616 and Long U.S. Pat. No. 4,702,943, both of which are incorporated herein by reference. As explained in detail in these patents, the converging shape of the chamber 16 creates hydrodynamic pressures in the saturant 17 to pressurize the saturant in the exit region 20 as compared to the entrance region 18. Typically, the element 14 is substantially in contact with the second side 28 of the web 22 in the exit region 20, and in no case is the gap greater than ¼ of an inch.

Figure 4:
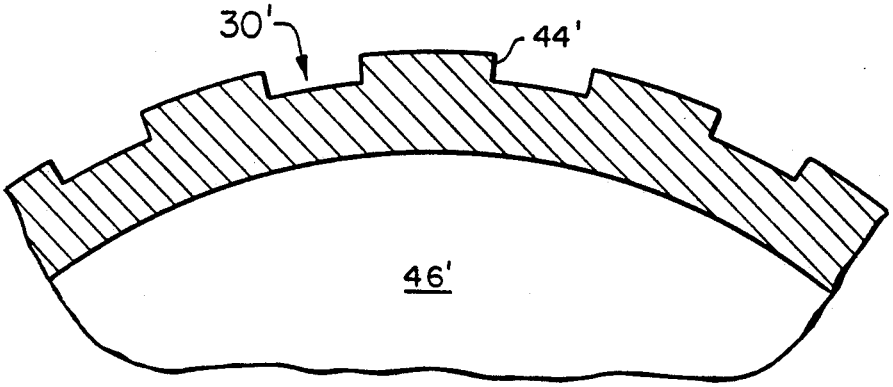
FIG. 4 is a fragmentary cross sectional view showing the belt of FIG. 3 flexed across its width to open the slots for cleaning.

The Menser patent defines the presently preferred geometry for the chamber 16. In addition, the Menser patent defines preferred arrangements for seals (not shown in the figure) which enclose the chamber 16. As pointed out in the Long patent, there are advantages to pivotably mounting the second element 14, as shown for example in FIG. 4 of the Long patent. Furthermore, the port should preferably extend across the full width of the saturated region in order to improve the uniformity of saturation, as shown for example at FIG. 5 of the Long patent.

Figure 2:
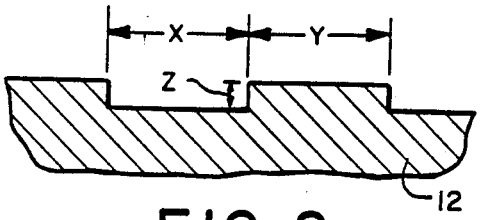
FIG. 2 is an enlarged fragmentary cross sectional view of the grooves in the mandrel of the saturator of FIG. 1.

Preferably, the mandrel 12 is provided with grooves as described in the Menser patent. In this preferred embodiment the grooves are approximately 0.125 inches in depth, formed on center lines approximately 0.250 inches apart, and are approximately 0.125 inches in width. FIG. 2 shows a cross-section of a preferred groove configuration, and the preferred dimensions for the distances X, Y and Z of FIG. 2 are 0.125, 0.125 and 0.125 inches, respectively. Preferably, the grooves spiral out from the center of the mandrel, though a series of circular grooves may be used as well. Also, deeper grooves may be used if desired. One alternative groove configuration that has been proposed uses the following dimensions: X=0.062, Y=0.062, Z=0.010 inches. Grooves with other profiles may also be suitable.

According to this invention a gas receiving belt such as a porous belt 30 is passed through the chamber 16 by a guide means which includes guide rollers 38. As shown in the drawing, the porous belt 30 is interposed between the mandrel 12 and the first side 26 of the web 22. Preferably, the belt 30 is a closed loop belt which is porous and substantially incompressible.

As shown in FIG. 1, the porous belt 30 is passed through a cleaning system 32 and a drying system 34 before it re-enters the chamber 16. The cleaning system 32 may for example include means for immersing the porous belt 30 in a cleansing bath, such as a high strength detergent. After the belt leaves the cleaning system, it is dried in the drying system 34, as for example with jets of heated air. Of course, the exact structure of the cleaning system 32 and the drying system 34 will depend upon the nature of the belt 30 and the saturant 17. In each case, the systems 32, 34 should be effective to remove any excess saturant on the belt 30, and to substantially dry the belt before it re-enters the chamber 16.

In the event saturation parameters are chosen such that no saturant penetrates the web 22 to come into contact with the belt 30, the belt 30 can be transferred directly from the guide roller **38*a* to the roller 38*b* as shown in dotted lines in FIG. 1 to bypass the systems 32, 34. Of course, in this case some provision must be made to take up the extra length of the belt 30. In some embodiments it may be desirable to wrap the belt 30 closely around the mandrel, thereby dispensing with the need for any guide rollers 38**.

This invention is not limited to a porous belt 30 of any particular composition. Those skilled in the art are familiar with a number of suitable materials, such as the belts used for removal in presses such as the Beloit Extended Nip ® Press and the Beloit Tri-Nip ® Press. The belt should be porous and relatively incompressible. It should protect the web 22 from deformation by the grooves of the mandrel 12, and it should have a surface texture that does not leave an undesirable imprint on the web.

The saturator 10 can be used to practice the method of this invention. Preferably the web 22 is a self supporting web which is substantially air dry before it enters the chamber 16. The belt 30 is carefully positioned prior to entering the chamber 16 to meet with the web 22 substantially uniformly across the full width of the web 22. The belt 30 enters the chamber 16 in contact with the web 22 opposite the surface 28 of the web 22 that will receive the saturant 17. The belt 30 is powered to travel at the same speed as the web 22. In the saturating chamber 16 the belt 30 supports and drives the web 22 through the friction created by the pressurization of the saturant 17. As pointed out above, the belt 30 is preferably made of a relatively incompressible material so that the pores of the belt are not reduced significantly by the pressure of the saturant 17. During the saturation process the pores of the belt 30 receive gases such as air and any excess saturant that has passed through the web 22 during saturation. The belt is preferably selected to have the appropriate porosity to achieve the level or depth of impregnation desired for the web 22. Belts with higher levels of porosity will allow the gases in the substrate the be expelled more readily, thus allowing the saturant to enter the web 22 and to penetrate more deeply. Conversely, a lower porosity for the belt 30 will reduce the level of saturation. Gases such as air which have passed through the belt are allowed to escape from the chamber 16 via the grooves in the mandrel 12.

Figure 3:
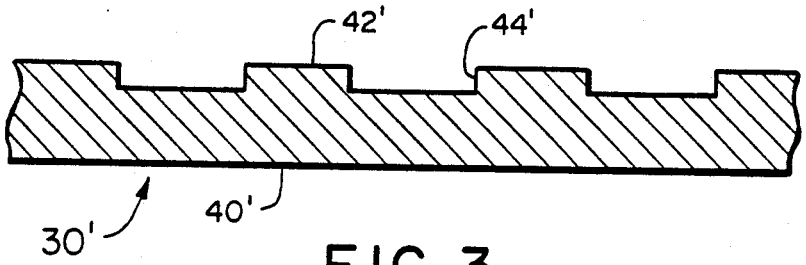
FIG. 3 is a fragmentary cross sectional view of an alternate belt suitable for use in the saturator of FIG. 1.

In the belt 30 described above the porosity of the belt itself provides means for receiving gases and excess saturant from the web 22. It should be understood however that this invention is not limited to porous belts, and impermeable belts can be used as long as a suitable means for receiving gases and excess saturant is provided in the belt. FIG. 3 shows one such impermeable belt 30' which can be used in the saturator of FIG. 1 in place of the porous belt 30. The impermeable belt 30' defines a flat side 40' which in use contacts the mandrel 12 and a slotted side 42' which in use contact the web 22. The slotted side 42' defines an array of slots 44' which conduct gases from the web 22 out of the saturating zone. The belt 30' itself protects the mandrel 12 from contact with any excess saturant that passes through the web 22.

In this embodiment the slots 44' defined by the belt 30' extend parallel to the direction of movement of the belt 30'. The depth and spacing of the slots 44' should be chosen to provide the desired degree of support for the web 22 and the desired rate of gas removal from the web 22. In general, lighter weight webs will be distorted less by closely spaced slots, and high levels of saturation will benefit from large slots. A range of materials such as hard rubbers, plastics and the like may be used for the belt 30'.

The belt 30' provides important advantages over the grooved mandrel of the prior art saturators described above. First, the belt 30' may be replaced relatively inexpensively when it is desired to alter the slot configuration for a particular web or saturation process. Second, the belt 30' may be more readily cleaned of excess saturant than the mandrel 12. The belt 30' can be separated from the mandrel 12 and subjected to extensive cleaning operations. By adjusting the length of the belt 30' properly, the time and space needed for effective cleaning may be provided. Furthermore, the belt 30' may be subjected to cleaning operations unsuitable for the mandrel 12. For example, the belt 30' may be flexed across its width (FIG. 4) with a spreader roll or the like 46' to open the slots 44' and facilitate mechanical cleaning with brushes. In addition, flexing the belt 30' along its length over rollers such as guide rollers 38 may assist in dislodging any hardened saturant on the belt 30'.

The method and apparatus of this invention provide important advantages. The belts 30, 30' allow gases such as air and any excess saturant to be removed from the porous web or substrate 22 while the web is being saturated. This system promises to provide improved control over the amount of saturant impregnated into the web and the depth to which the saturant is impregnated within the web. Furthermore, the belts 30, 30' provide a means by which excess saturant may be received, carried away from the saturator and discarded. This cleaning action of the belts 30, 30' prevents saturant build-up on the mandrel 12 and allows continuous operation. The cleaning and drying systems 32, 34 assure that a clean and open pore belt 30 or open slot belt 30' is consistently provided to receive gases and excess saturant from the web during the impregnation process.

As yet another advantage of this invention, the grooves on the mandrel do not deform the web 22 because the belts 30, 30′ are interposed between the grooved mandrel 12 and the web 22. For this reason, it is anticipated that coarser grooves can be used in the mandrel 12, and that such coarser grooves can be formed more economically than fine grooves. Furthermore, a single, coarsely grooved mandrel can be used with a wider variety of webs or substrates. The belts 30, 30′ can readily be replaced at a significantly lower cost than that of replacing the mandrel 12. It is anticipated that the belts 30, 30′ will provide more uniform impregnation, and therefore more uniform appearance to the impregnated web.

Of course, it should be understood that a wide range of changes and modifications can be made to the preferred embodiments described above. For example, this invention is not limited to use with saturators of the type which employ mandrels, but can also be adapted for use with saturators such as that shown in FIG. 8 of Long U.S. Pat. No. 4702,943 which employ two opposed, rigid, fixed, chamber defining elements. Furthermore, this invention can be used with saturators which do not include converging chambers, but which rely on an external pressure source to pressurize the saturant within a constant depth chamber. This invention can also be used with other types of saturators that include saturating zones that are not saturating chambers. For example, nip roller saturators that apply pressure to a substrate in contact with saturant in a saturating zone between the nip rollers can be adapted for use with this invention. In addition, the chamber defining element adjacent the web may be perforated rather than grooved as described above.

It is therefore intended that the foregoing detailed description be regarded as illustrative rather than limiting, and that it be understood that it is the following claims, including all equivalents, which are intended to define the scope of this invention.

I claim:

1. A pressure saturator comprising:

first and second elements configured to define a saturating zone therebetween;

means for passing a substrate through the saturating zone with a first side of the substrate adjacent the first element;

means for introducing a liquid saturant into the saturating zone such that the saturant contacts a second side of the substrate and impregnates the substrate as the substrate passes through the saturating zone; and a belt interposed between the substrate and the first element and in contact with the first side of the substrate;

said belt comprising means for receiving gases and at least some of any excess saturant from the first side of the substrate as the saturant enters the substrate in the saturating zone, thereby protecting the first element from contact with the saturant.

2. The invention of claim 1 wherein the belt is configured as a closed loop.

3. The invention of claim 2 wherein the invention further comprises means for cleaning the belt after it leaves and before it re-enters the saturating zone.

4. The invention of claim 3 wherein the invention further comprises means for drying the belt after it leaves the cleaning means.

5. The invention of claim 1 wherein the first element defines an array of grooves configured to conduct gases from the belt out of the saturating zone.

6. The invention of claim 1 wherein the first element comprises a mandrel.

7. The invention of claim 1 wherein the belt comprises a porous portion, and wherein the porous portion comprises the gas receiving means.

8. The invention of claim 1 wherein the gas receiving means comprises an array of slots formed in the belt and positioned adjacent the first side of the substrate.

9. The invention of claim 8 wherein the belt is configured as a closed loop, wherein the invention comprises means for cleaning the belt after it leaves and before it re-enters the saturating zone, and wherein the cleaning means bends the belt across its width to open the slots and facilitate cleaning.

10. A pressure saturator comprising:

a first and second opposed, rigid elements configured to define a converging chamber therebetween, said chamber having an entrance region and an exit region, wherein the chamber converges in depth from a relatively greater depth at the entrance region to a relatively smaller depth at the exit region, and wherein the second element is substantially fixed in place during use;

means for passing a substrate through the chamber from the entrance region to the exit region adjacent the first chamber defining element;

means for introducing a liquid saturant into the chamber between the substrate and the second chamber defining element;

a belt; and means for passing the belt through the chamber with the belt interposed between the substrate and the first chamber defining element;

said belt comprising means for receiving gases and at least some of any excess saturant from the substrate as the saturant enters the substrate in the converging chamber, said chamber shaped and configured such that movement of the saturant in the chamber pressurizes the saturant at the exit region to a higher pressure than at the entrance region.

11. The invention of claim 10 wherein the belt is configured as a closed loop.

12. The invention of claim 11 wherein the invention further comprises means for cleaning the belt after it leaves and before it re-enters the chamber.

13. The invention of claim 12 wherein the invention further comprises means for drying the belt after it leaves the cleaning means.

14. The invention of claim 10 wherein the first element defines an array of grooves configured to conduct gases from the belt out of the chamber.

15. The invention of claim 10 wherein the first element comprises a mandrel.

16. The invention of claim 10 wherein the belt comprises a porous portion, and wherein the porous portion comprises the gas receiving means.

17. The invention of claim 10 wherein the gas receiving means comprises an array of slots formed in the belt and positioned adjacent the substrate.

18. The invention of claim 17 wherein the belt is configured as a closed loop, wherein the invention comprises means for cleaning the belt after it leaves and before it re-enters the saturating zone, and wherein the cleaning means bends the belt across its width to open the slots and facilitate cleaning.

19. A method for removing gases and excess saturant from a substrate during saturation, said method comprising the following steps:

(a) introducing a liquid saturant into a saturating zone defined between two elements;

(b) passing a substrate through the zone with a first side of the substrate positioned adjacent a first one of the elements while pressurizing the saturant in the zone to impregnate the saturant into a second side of the substrate, opposed to the first side; and (c) passing a gas receiving belt through the zone between the substrate and the first element to cause gases and at least some of any excess saturant to enter the belt.

20. The method of claim 19 wherein the belt is configured in a closed loop and the belt is recycled through the zone in step (c).

21. The invention of claim 20 wherein the method further comprises the step of cleaning the belt after it leaves and before it re-enters the zone.

22. The method of claim 21 further comprising the step of drying the belt after it leaves the cleaning step.

23. The method of claim 19 wherein the first element comprises a mandrel.

24. The method of claim 19 wherein the first element defines an array of grooves configured to conduct gases from the belt out of the zone.

25. The method of claim 19 wherein the substrate is a self supporting, porous, substantially air dry substrate prior to step (b).

26. The method of claim 19 wherein the gas receiving belt comprises a porous material that is passed through the zone in contact with the first side of the substrate in step (c).

27. The method of claim 19 wherein the gas receiving belt defines an array of gas receiving slots positioned in contact with the first side of the substrate when the belt is passed through the zone in step (c).

28. The method of claim 27 wherein the belt is configured in a closed loop and is recycled through the zone in step (c); wherein the method further comprises the step of cleaning the belt after it leaves and before it re-enters the zone; and wherein the cleaning step comprises the sub-step of bending the belt across its width to open the slots and facilitate cleaning.

29. A method for removing gases and excess saturant from a substrate during saturation, said method comprising the following steps:

(a) introducing a liquid saturant into a saturating chamber defined between two elements, said chamber defining an entrance zone and an exit zone and converging in depth from a greater depth in the entrance zone to a lesser depth in the exit zone;

(b) passing a substrate through the chamber with a first side of the substrate positioned adjacent a first one of the chamber defining elements, said chamber shaped such that movement of the substrate and the saturant through the chamber pressurizes the saturant to a greater pressure in the exit zone than the entrance zone to impregnate the saturant into a second side of the substrate, opposed to the first side; and (c) passing a gas receiving belt through the chamber between the substrate and the first chamber defining element to cause gases and at least some of any excess saturant to enter the belt.

30. The method of claim 29 wherein the belt is configured in a closed loop and the belt is recycled through the chamber in step (c).

31. The method of claim 30 wherein the method further comprises the step of cleaning the belt after it leaves and before it re-enters the chamber.

32. The method of claim 31 further comprising the step of drying the belt after it leaves the cleaning step.

33. The method of claim 29 wherein the first chamber defining element comprises a mandrel.

34. The method of claim 29 wherein the first chamber defining element defines an array of grooves configured to conduct gases from the belt out of the chamber.

35. The method of claim 29 wherein the substrate is a self supporting, porous, substantially air dry substrate prior to step (b).

36. The invention of claim 29 wherein the gas receiving belt comprises a porous material that is passed through the zone in contact with the first side of the substrate in step (c).

37. The method of claim 29 wherein the gas receiving belt defines an array of gas receiving slots positioned in contact with the first side of the substrate when the belt is passed through the zone in step (c).

38. The method of claim 37 wherein the belt is configured in a closed loop and is recycled through the zone in step (c); wherein the method further comprises the step of cleaning the belt after it leaves and before it re-enters the zone; and wherein the cleaning step comprises the sub-step of bending the belt across its width to open the slots and facilitate cleaning.

* * * * *